US006264041B1

(12) United States Patent
Niitti

(10) Patent No.: US 6,264,041 B1
(45) Date of Patent: Jul. 24, 2001

(54) ADJUSTABLE SPLITTER ASSEMBLY FOR SPIRAL SEPARATOR

(75) Inventor: Timo U. Niitti, Ponte Vedra, FL (US)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/491,277

(22) Filed: Jan. 26, 2000

(51) Int. Cl.[7] ..... B03B 5/52; B07B 11/00; B07C 7/00

(52) U.S. Cl. ..... 209/459; 209/493; 209/697

(58) Field of Search ..... 209/459, 493, 209/494, 696, 697, 460

(56) References Cited

U.S. PATENT DOCUMENTS 1,516,926 * 11/1924 Pardee ..... 209/697
2,615,572 * 10/1952 Hodge ..... 209/459
2,952,360 * 9/1960 Oberg ..... 209/459
3,319,788 * 5/1967 Reichert ..... 209/697
4,614,580 * 9/1986 Giffard ..... 209/459
4,795,553 * 1/1989 Giffard ..... 209/459
4,836,926 * 6/1989 Grobler ..... 210/512.1
5,953,797 * 12/1999 Provost et al. ..... 24/452

FOREIGN PATENT DOCUMENTS

222598 * 7/1959 (AU) .

* cited by examiner

*Primary Examiner*—Donald P. Walsh
*Assistant Examiner*—Joseph C Rodriguez
(74) *Attorney, Agent, or Firm*—Arthur G. Yeager

(57) ABSTRACT

An adjustable splitter assembly at any position along the spiral trough and the splitter is angled to a fixed position pressed against the trough and locked against movement by a long arm selectively clamped in one hook of a retainer having spaced hook sockets, the retainer being attached to the outer rim of the trough either upstream or downstream from the splitter. The splitter may be angularly adjusted to position its leading edge at different locations along an arc with respect to the stream of particles flowing down the trough by moving the arm to another selected hook socket.

20 Claims, 4 Drawing Sheets

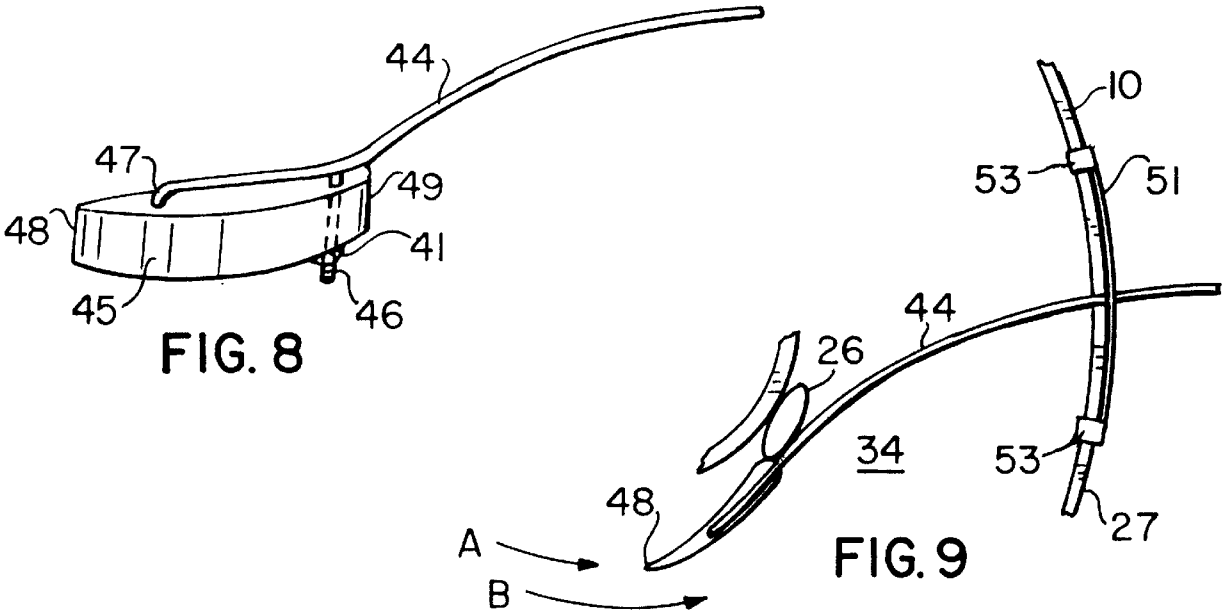
FIG. 8
FIG. 9
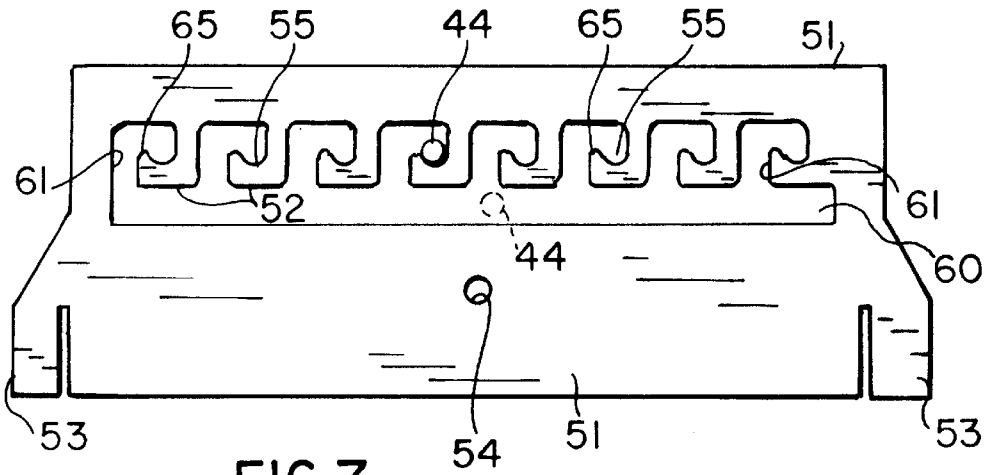
FIG. 7

ADJUSTABLE SPLITTER ASSEMBLY FOR SPIRAL SEPARATOR

CROSS-REFERENCE TO RELATED APPLICATIONS

Not Applicable.

STATEMENT REGARDING FEDERALLY SPONSORED RESEARCH

Not Applicable.

REFERENCE TO A MICROFICHE APPENDIX

Not Applicable.

BACKGROUND OF THE INVENTION (1) Field of the Invention

This invention relates to a spiral trough separator for separating heavy particles from light particles where the particles normally result from mining operations; and, more particularly, this invention relates to an assembly for adjustment of a splitter and maintaining same in position in the spiral trough so as to separately recover one particle fraction from another.

(2) Description of the Related Art

U.S. Pat. No. 5,452,805 issued Feb. 9, 1993, describes and claims a spiral trough separator having spaced groups of parallel grooves in the trough to enhance the separation of solids from slurries of those solids.

U.S. Pat. No. 4,189,378 issued Feb. 19, 1980, describes and claims a spiral separator for dividing mineral fractions of different sizes of particles having at various locations in the helical trough a slotted opening through which a slurry of particles may be drawn off as a product; the opening being controlled in length by a slide and a splitter project upwardly into the trough, and the stream in the trough may be divided into different parts of the opening and thereafter to different product recovery zones of concentrate and middlings, for example. The splitter position is controlled by a manual adjustment slide mechanism allowing it to be positioned at any desired location from one end to the other of the slotted opening. This arrangement is not only complicated and expensive and relies on changes of size of the opening and associated piping, but is subject to potential jamming of the slide when fine particles become lodged in the slide mechanism.

BRIEF SUMMARY OF THE INVENTION

The present invention is an adjustable assembly for positioning a splitter in the trough of a spiral separator which carries a slurry of particles down the spiral for the purpose of separating the particles into fractions of different specific gravities. The assembly includes an elastomeric splitter vane attached to one end of a long springy rod while the other end of the rod is locked in place by any one of a plurality of spaced hook sockets. The rod is designed and shaped to press the splitter against the trough when the free end is locked into place by a selected hook socket, and this pressure on the splitter prevents it from becoming dislodged from the trough and thereby failing to produce a sharp separation between different particles. The splitter when locked cannot be moved even during high pressure washing of the spiral. When unlocked, the force from the rod pressing the splitter against the upper surface of the spiral is released and the splitter can be readily pivoted to a new position, without any jamming due to the slurry, and the rod relocked into another hook socket.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 7 is a side elevational view of the hook socket retainer according to the second embodiment of the invention;

FIG. 8 is a perspective view of the splitter according to the second embodiment of the invention; and FIG. 9 is a plan view of the splitter and retainer of the second embodiment on the spiral trough.

DETAILED DESCRIPTION OF THE INVENTION

This invention is an improvement in the art of spiral conveyor separators which are commonly in use in the field of mining and metallurgy where it is important to separate particles of rock from particles of valuable minerals, such as rutile, ilemite, chromite, etc., or metals, e.g., gold. It has been known that by feeding aqueous slurries of metals and the rock naturally occurring with those metals into a vertically spiral trough the forces of gravity and centrifugal energy will cause the heavier particles to separate from the lighter particles sufficiently to allow a splitter to divert the two streams and permit the recovery of two different grades of particles. The feed to the spiral conveyor is the product of grinding and size separation techniques which result in particles of rock and metal that are about the same size although the rock particles are lighter in specific gravity than the metal particles. In order to recover the metal separated from the rock there must be a further separation of the heavier particles from the light particles, and the present invention is for that purpose. An aqueous slurry of the particles is the most convenient way of accomplishing that, because the slurry provides a flowing stream of particles that can be passed around turns and allow the particles to move separately from the water and find their own position based upon their weight. Generally the lighter particles will flow to the outer edges of the spiral and the heavier particles will remain closer to the center of the spiral. Of course, the higher speed of the slurry around the spiral will move the heavier particles away from the center due to centrifugal force. In any event these forces can be controlled by the speed of the slurry movement, and this control permits a separation to be reached at some controlled speed of slurry.

It is the purpose of the present invention to provide an intermediate separation of particles at one or more selected positions along the spiral instead of only one separation at the exit end of the spiral. This method permits a greater degree of control for the operator by allowing a drawoff of product wherever the desired separation occurs along the spiral rather than dedicating the entire spiral to a separation that only required a portion of the spiral rather than the entire length thereof.

Figure 1:
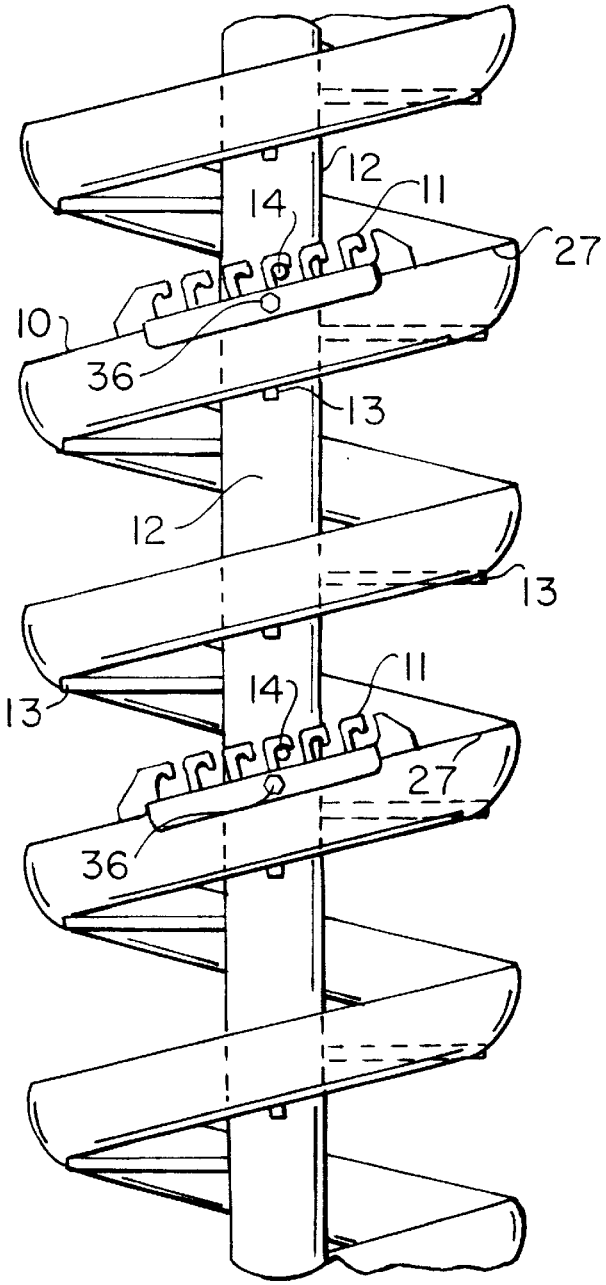
FIG. 1 is a front elevational view of a typical spiral trough separator for the separation of mineral particles of a selected particle size from a slurry of particles having a wide range of particle sizes with a couple of the adjustable splitter assemblies according to this invention mounted thereto.
Figure 2:
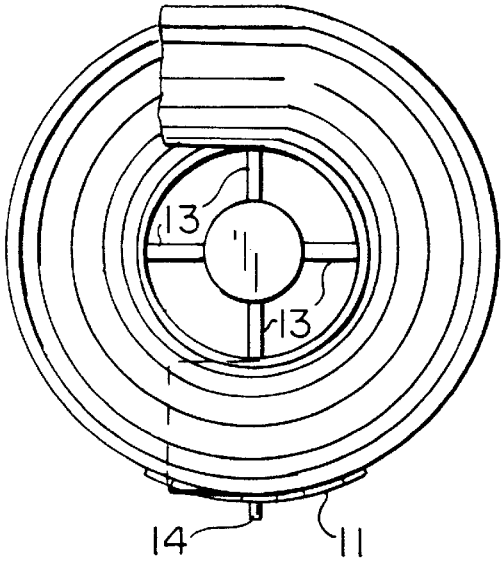
FIG. 2 is a top plan view of the separator of FIG. 1 without splitter assemblies.

In FIGS. 1 and 2 there is shown a portion of a vertical spiral conveyor having a spiral trough 10 which receives a feed slurry at some location above the upper limit of the drawing and discharges the slurry at some location below the lower limit of the drawing. The trough 10 is supported by a central axial column 12 and a plurality of support arms 13 extending horizontally outward from the central column 12. A hook lock socket retainer 11 is positioned along the outer rim of the trough 10 near wherever a separation product is to be located, as will be explained hereinbelow.

Figure 3:
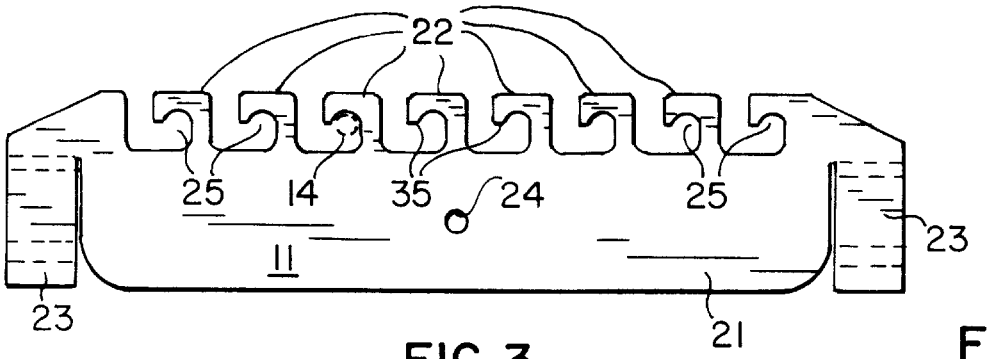
FIG. 3 is a side elevational view of the hook socket retainer according to the first embodiment of the invention which is attached to the rim of the trough of the separator of FIG. 1.
Figure 4:
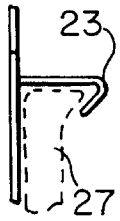
FIG. 4 is an end elevational view of the hook socket retainer shown in FIG. 3 with the rim shown in broken lines.
Figure 5:
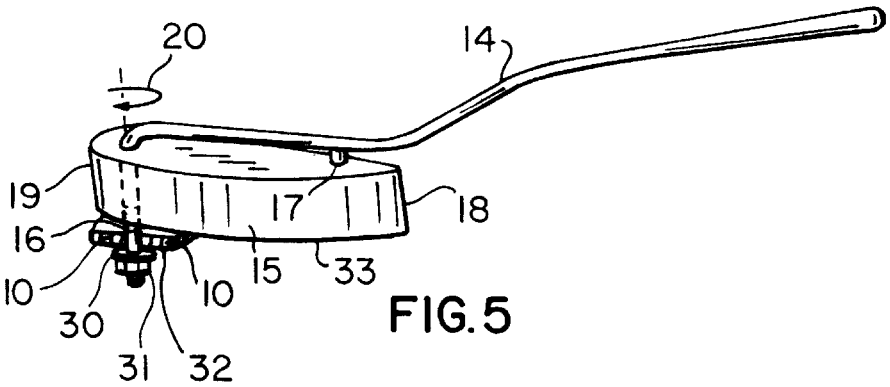
FIG. 5 is a perspective view of the splitter according to the first embodiment of the invention.
Figure 6:
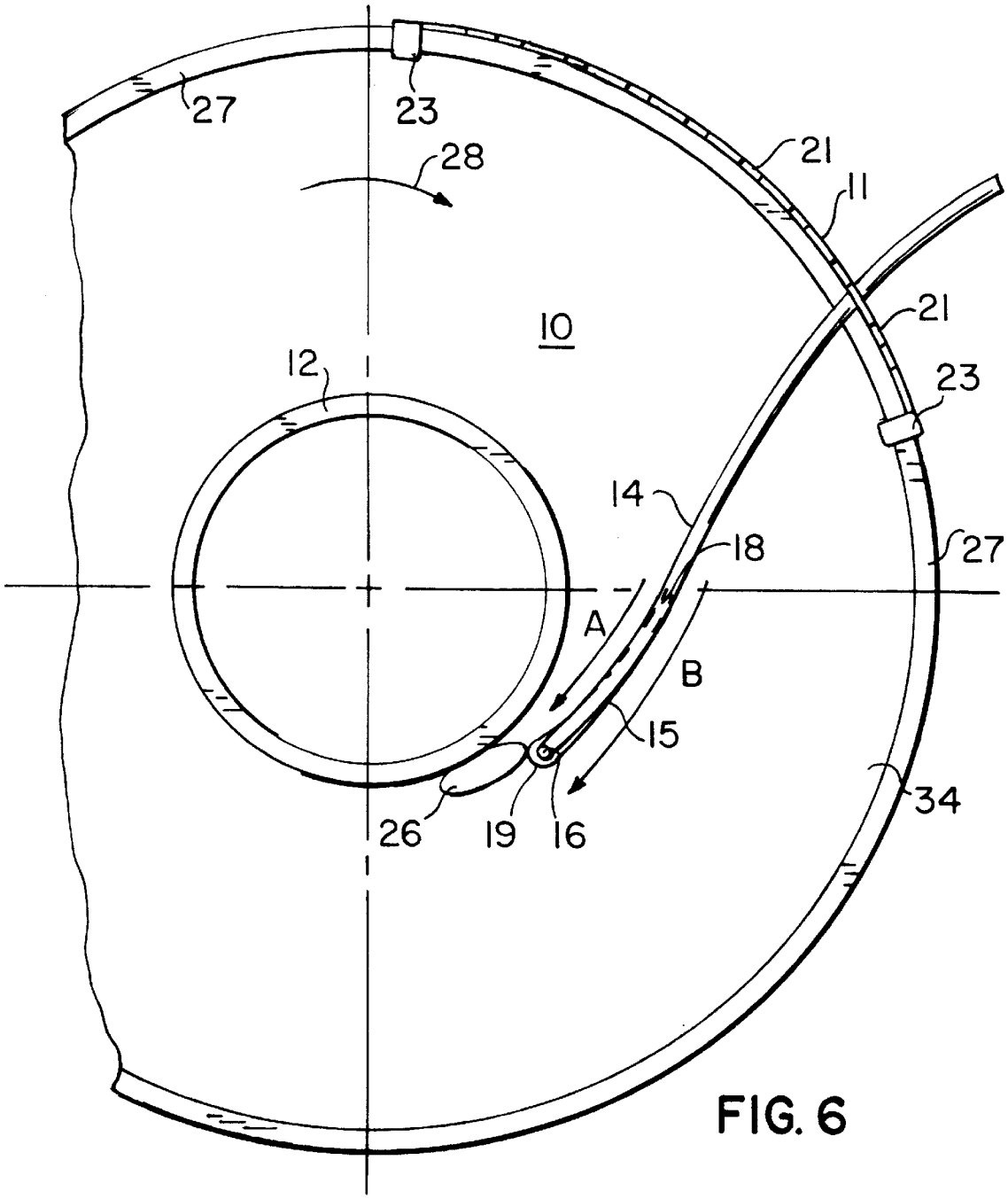
FIG. 6 is a plan view of the splitter and retainer of the first embodiment, with the splitter in a selected position in the spiral trough of the separator.

In FIGS. 3–5 there are shown the details of the splitter 15 and retainer 11 positioned to function in separating different sizes and grades of partical product. In FIG. 6 the direction of the slurry flow 28 is illustrated to be clockwise around central column 12. One or more hook socket retainer 11 is shown in detail in FIGS. 3 and 4 and will be described more fully hereinafter. The slurry has divided itself into two parts (shown by arrows A and B) and this permits a separation by the placement of splitter 15 with its sharp end 18 upstream so as to direct the desired product into retrieval tube entrance 26 where it will be drawn off as a product. Splitter head or vane 15 is physically connected to arm 14 which, in turn, is held rigidly in position by being in a hook of the socket retainer 11. Splitter head 15 is maintained steady by spine or pivot portion 16 pressed in a recess or hole in trough 10 and is attached thereto by a washer 30 and threaded nut 31 generally shown in FIG. 5. Thus, the particles of the slurry intended to be diverted by splitter head 15 cooperates with the position of retrieval tube entrance 26 in a manner well known in the art.

Spine 16 passes through splitter head 15 and is pivotally or rotatably attached to trough 10 to pivot as indicated by arrow 20. In this embodiment the spine 16 is located at the downstream end portion 19 of head 15. The upstream end 18 of head 15 is nonrotatably attached to arm 14 by support 17. The bottom surface of head 15 may be curved or substantially planar to be similar to the surface of spiral trough 10 so as to form a reasonably snug seal when head 15 is pressed against trough 10 by the force of the spring or downward bend of the arm 14 when the arm 14 is moved into its locked position. Spine 16 preferably is threaded on its end to receive a washer 30 and a nut 31 which may be tightened without compressing head 15 against the bottom surface 32 of the spiral trough 10 without effecting the pivoting of spine 15. The outer shape of head 15 is somewhat like that of a boat with the upstream end 18 sharp like the bow and the downstream end 19 is enlarged like the aft end of a boat. The two ends 18 and 19 are connected by two similarly curving streamlined walls which will allow the liquid slurry to pass by on both sides with as little disturbance as possible.

Arm 14 is of springy metal, such as stainless steel, and is sufficiently long to reach beyond the outer rim of trough 10 and be pressed into the selected hook of the socket retainer 11. If the arm 14 is shaped correctly it will, when hooked into strip 11, apply a downward bending force to elastomeric head 15 causing the bottom surface 33 thereof to be pressed tightly against the upper surface 34 of trough 10.

In FIG. 6 it may be seen that by providing a product drawoff hole or entrance at 26 connected to appropriate retrieval piping or tubing, a desired product of particles of a special density in an aqueous slurry may be retrieved. The positioning of a splitter head 15 and arm 14 may be placed appropriately to divide the desired product into stream A to exit through entrance 26 while the remainder B of the slurry can continue on down the trough 10 to another separation or to collection point. The position for splitter spine 16 is determined adjacent a drawoff hole 26 and a hole is drilled there to fasten the spine 16 at that point. The hook socket retainer 11 is located upstream, in this embodiment, at a suitable place along outer rim 27 of trough 10 and another hole is drilled therethrough to affix the retainer 11 to the rim 27 of trough 10.

FIG. 3 shows a hook socket retainer 11 as a punched out flat plate. The retainer 21 will be bent along a radius to curve same to fit along the outside rim 27 of trough 10 when in use. Along the top edge of retainer 21 are a series of identical hook sockets 22. These sockets 22 may be cut by hand or punched out on a press. Each socket 22 has a hook-shaped body surrounding a hook-shaped space 25 so as to provide about 6–8 hooks spaced along retainer 11. The arm 14 of the splitter head 15 will slide into a selected space 25 and be retained thereat due to the springy material from which the arm 14 is formed, as well as the shoulder 35. Generally, the arm 14, shown in broken lines in FIG. 3, is about perpendicular to space 25 so that it can be readily placed and removed therefrom. Wings 23 at each end of strip 21 are bent over as shown in FIG. 4, so that they clip over the outside rim wall 27 of trough 10 to hold the strip 21 in a steady position. A bolt connector 36 passes through hole 24 of retainer 21 and holds same firmly against the outside of trough 10 and prevents disengagement of clip wings 23 from their positions illustrated in FIG. 4. It therefore, is apparent that a retainer 21 is readily available to be attached where needed to steady a splitter 15 wherever desired along trough 10.

Sometimes it may become necessary to apply the principles of this invention in a reverse manner, e.g., when an easier access to the arm 14 may dictate or if the arrangement of an array of many spirals is such that it makes the use in the manner shown in FIGS. 1–6 impractical. FIGS. 7, 8 and 9 depict this reverse modification and generally correspond to FIGS. 3, 5 and 6. The splitter upstream end 48 remains above the drawoff entrance 26 as shown in FIG. 9. However, the head 45 is attached at the far end of arm 44 by support 47 with spine 46 being intermediate of the ends of arm 44 and passing through head 45 adjacent larger end 49 of head 45. The lock tooth retainer 51 is formed with a plurality of spaced hooks 52 in the form of sockets 55 communicating with an elongated common slot 60 via generally vertical access passageways 61. When the arm 44 is locked in a socket 55 shown in full lines in FIG. 7 there is a compressive force transferred from the springy steel arm to the compressible head 45 to seal the head 45 to the spiral upper surface 34 of the spiral 10. When the position of the arm 44 is to be adjusted, the arm 44 must be forced upwardly to clear shoulder 65 of socket 55, pass down passageway 61 to slot 60 as shown by broken lines 44. Accordingly, the head 45 is not compressed against the spiral upper surface 34 and may pivot about spine 41 in much the same manner as head 15 pivoted about spine 16 in the embodiment of FIGS. 3–6. The attachment wings or clips are illustrated in this embodiment at 53 and the support bolt hole 54 corresponds to hole 24.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by letters patent of the united states is:

1. An adjustable splitter assembly for attachment to a vertical axis spiral separator including a trough having an internal concave surface adapted to direct a flow of a slurry of solid particles in a liquid medium in a downward helical path to a product drawoff entrance in the trough, said assembly comprising a splitter having an elongated elastomeric divider body with a sharp edged portion generally vertical upstream and an enlarged portion generally downstream and a bottom surface that generally matches the surface of the trough at a location adjacent a drawoff entrance, said splitter further having an elongated arm attached to said body and extending outwardly beyond an outer rim of the trough, an elongated retainer attached to the outer rim of the trough having a plurality of sockets extending upwardly above said rim, said arm being resiliently bendable into a selected one of said sockets to lock said arm against further movement with respect to the rim and to forcibly press said splitter body substantially sealed against the surface of the trough.

2. The assembly of claim 1 further comprising a pin connector for pivotally joining said enlarged portion of said splitter body within a hole in the trough adjacent the drawoff entrance.

3. The assembly of claim 2 wherein said pin connector is integral with said arm, said arm having another portion connected to and supporting said sharp edged portion.

4. The assembly of claim 3 wherein said another portion is immovably affixed to said splitter body.

5. The assembly of claim 1 wherein said arm is a long slender rod of a springy metal.

6. The assembly of claim 1 wherein said retainer includes opposed ends and a pair of spaced clips at respective said ends which overlie the outer rim of the trough.

7. The assembly of claim 6 wherein each of said clips includes a downturned and outwardly directed flange which is adapted and arranged to engage an inwardly directed flange of the outer rim of the trough.

8. The assembly of claim 7 wherein said clips are integral with said sockets and said retainer is formed by a single sheet of pierced and cut metal and bent to form said clips.

9. The assembly of claim 6 further comprising a single connector generally medially of said retainer for affixing said retainer to said outer rim.

10. The assembly of claim 9 wherein said ends engage said rim and stabilize said retainer with said single connector therebetween.

11. The assembly of claim 2 wherein said arm is unlockable by pressing its outer end portion downwardly then laterally then upwardly and thence laterally pivoting about said pin connector to locate said sharp edge portion along an arc about said pin connector with said outer end of said arm being adjacent another said socket and being bent downwardly then laterally and released to move upwardly and become locked in said another socket.

12. The assembly of claim 1 further comprising another identical movable splitter located at least one turn of said spiral away from said splitter.

13. The assembly of claim 1 wherein said retainer is located downstream of a product drawoff entrance of the trough.

14. The assembly of claim 1 wherein said retainer is located upstream of a product drawoff entrance of the trough.

15. The assembly of claim 1 wherein said retainer sockets are formed along an elongated edge of a plate.

16. The assembly of claim 1 wherein said retainer sockets are formed generally medially of elongated edges of a plate.

17. The assembly of claim 1 wherein said sockets are hook-shaped to inhibit inadvertent movement of said arm locked in said one socket.

18. An adjustable splitter assembly for attachment to a vertical axis spiral separator including a trough having an internal concave surface adapted to direct a flow of a slurry of solid particles in a liquid medium in a downward helical path to a product drawoff entrance in the trough, said assembly comprising a splitter having an elongated body with a sharp edged portion generally vertical upstream, said body having a bottom surface that generally matches the surface of the trough at a location adjacent the drawoff entrance, an elongated arm attached to said body and extending outwardly beyond an outer rim of the trough, an elongated retainer attached to the outer rim of the trough having a plurality of sockets extending upwardly of the rim, said arm being resiliently bendable into a selected one of said sockets to lock said arm against further movement with respect to the rim of the trough and to forcibly press said splitter body substantially against the surface of the trough.

19. The assembly of claim 18 further comprising a pin connector for pivotally joining said splitter body within a hole in the trough adjacent the drawoff entrance, said pin connector being integral with said arm, said arm having another portion connected to and supporting said body, said another portion of said arm being immovably affixed to said body, said retainer including opposed ends and a pair of spaced clips at respective said ends which overlie the outer rim of the trough.

20. The assembly of claim 18 wherein said arm is unlockable by pressing its outer end portion upwardly then laterally then downwardly and thence laterally pivoting about said pin connector to locate said sharp edge portion along an arc about said pin connector with said outer end of said arm being adjacent another said socket and being bent upwardly then laterall and released to move downwardly and become locked in said another socket.

* * * * *